US010754280B2

(12) United States Patent
Kato et al.

(10) Patent No.: US 10,754,280 B2
(45) Date of Patent: Aug. 25, 2020

(54) HEATER AND IMAGE FORMING APPARATUS

(71) Applicant: Toshiba Lighting & Technology Corporation, Yokosuka-shi, Kanagawa-ken (JP)

(72) Inventors: Satoko Kato, Yokosuka (JP); Kentaro Kimura, Yokosuka (JP); Masahiko Tamai, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 249 days.

(21) Appl. No.: 15/919,816

(22) Filed: Mar. 13, 2018

(65) Prior Publication Data

US 2019/0094775 A1 Mar. 28, 2019

(30) Foreign Application Priority Data

Sep. 25, 2017 (JP) ..... 2017-183840

(51) Int. Cl.
*G03G 15/20* (2006.01)

(52) U.S. Cl.
CPC ..... *G03G 15/2039* (2013.01)

(58) Field of Classification Search
CPC ... G03G 15/2078; G03G 15/2039; H05B 3/00
USPC ..... 219/216; 399/67, 69, 329
See application file for complete search history.

(56) References Cited

U.S. PATENT DOCUMENTS

2005/0006370 A1* 1/2005 Suzumi ..... G03G 15/2064 219/216
2015/0277309 A1* 10/2015 Kuroda ..... G03G 15/2053 219/541
2017/0363998 A1* 12/2017 Takagi ..... G03G 15/2039

FOREIGN PATENT DOCUMENTS

JP 2010-244942 A 10/2010
JP 2015-060710 A 3/2015

* cited by examiner

*Primary Examiner* — Thien S Tran
(74) *Attorney, Agent, or Firm* — Banner & Witcoff, Ltd.

(57) ABSTRACT

A heater including a rectangular substrate; a resistance heat-generating element that is provided on one surface of the substrate along a longitudinal direction of the substrate; a thermistor that is provided on the other surface, which is a rear side of the one surface of the substrate, and measures temperature of the substrate; and a conductor that is provided on the other surface of the substrate, is extended up to an end portion of the substrate from the thermistor along the longitudinal direction of the substrate, and supplies power to the thermistor. A first connecting portion and a second connecting portion, which are connected to the conductor, are provided at both ends of the thermistor. A connection direction, in which the first connecting portion and the second connecting portion are arranged on the other surface of the substrate, is different from a lateral direction of the substrate.

5 Claims, 7 Drawing Sheets

HEATER AND IMAGE FORMING APPARATUS

CROSS-REFERENCE TO RELATED APPLICATIONS

This application is based upon and claims the benefit of priority from the Japanese Patent Application No. 2017-183840, filed on Sep. 25, 2017, the entire contents of which are incorporated herein by reference.

FIELD

Embodiments described herein relate to a heater and an image forming apparatus.

BACKGROUND

A heater used for toner fixing in a copier, a facsimile or the like, printing erasure or the like in a rewritable card reader, for example, is known. The heater causes a resistance heat-generating element formed on one surface of a substrate to generate heat using power supplied from a power supply electrode.

Generally, the resistance heat-generating element extends in a band shape along a longitudinal direction of an elongated substrate. The heater has a tendency that a temperature distribution is generated in the longitudinal direction of the substrate due to a difference between recording widths (lengths of recording sheets with respect to the longitudinal direction of the substrate) heated by the resistance heat-generating element. In a case where a temperature gradient that is generated between a central portion in the longitudinal direction of the substrate and both end portions thereof becomes large, there is a problem that cracks occur in the substrate due to the influence of thermal expansion.

As a countermeasure, on the substrate, a thermistor that measures temperature of the substrate is provided on the other surface thereof (a rear side of one surface on which the resistance heat-generating element is formed) with which a recording sheet, which is a heating target body, is in slidable contact. In the heater, there is a technique in which the temperature distribution in the longitudinal direction of the substrate is made uniform by controlling the amount of heat generated by the resistance heat-generating element, on the basis of the measurement result of the thermistor. A technique, in which a conductor that supplies power to the thermistor and the thermistor are formed on the other surface of the substrate using printing patterns, and a first connecting portion and a second connecting portion that are respectively connected to both ends of the conductor and the thermistor, are arranged along a lateral direction of the substrate, is known.

However, since the first connecting portion and the second connecting portion are formed as the respective printing patterns of the conductor and the thermistor overlap each other, a projection portion is formed in a thickness direction of the substrate. On the other hand, when the heater heats a recording sheet, the recording sheet is sent along the lateral direction of the elongated substrate. Thus, the recording sheet, which is indirectly in slidable contact with the other surface of the substrate through a fixing film, is continuously rubbed against two projection portions that correspond to the first connecting portion and the second connecting portion, which are arranged in a sending direction (in the lateral direction of the substrate) of the recording sheet, and thus, there is a concern that printing unevenness, so-called stripes (lines) in printing are easily generated.

A problem to be solved by the present disclosure is to provide a heater and an image forming apparatus capable of preventing connecting portions between a thermistor and a conductor from being continuously in slidable contact with a heating target body with which the connecting portions are indirectly in slidable contact.

DETAILED DESCRIPTION

Figure 1:
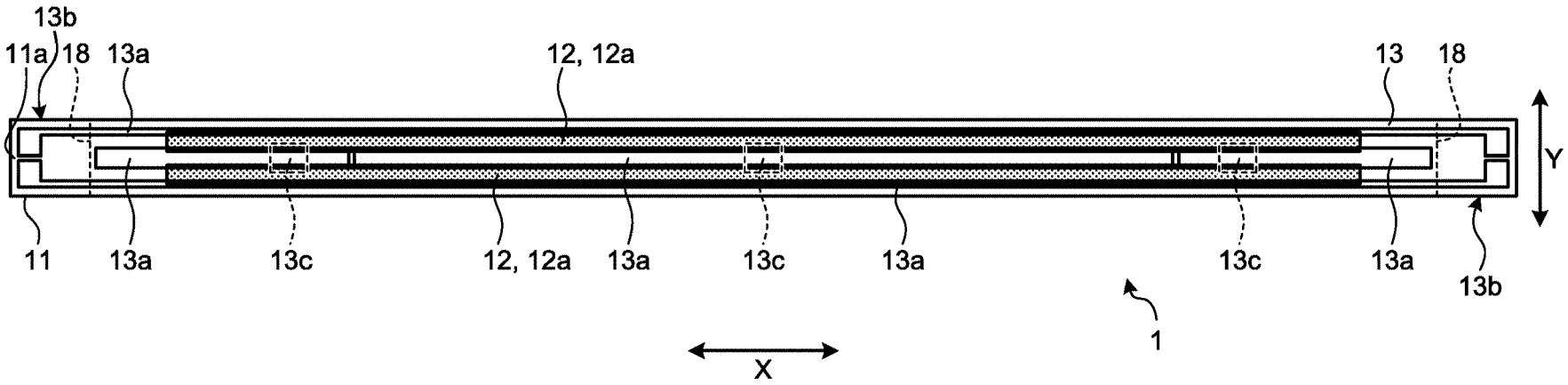
FIG. 1 is a plan view illustrating a heater according to an embodiment, seen from one surface side of a substrate.

A heater 1 according to an embodiment to be described hereinbelow includes a rectangular substrate 11, a resistance heat-generating element 12, a thermistor 14, and a conductor (a second conductor pattern 15). The resistance heat-generating element 12 is provided on one surface 11*a* of the substrate 11 along a longitudinal direction of the substrate 11. The thermistor 14 is provided on the other surface 11*b* that is a rear side of the surface 11*a* of the substrate 11. The thermistor 14 measures temperature of the substrate 11. The conductor (the second conductor pattern 15) is provided on the other surface 11*b* of the substrate 11. The conductor (the second conductor pattern 15) is extended from the thermistor 14 to an end portion of the substrate 11 along the longitudinal direction of the substrate 11. The conductor (the second conductor pattern 15) supplies power to the thermistor 14. At both ends of the thermistor 14, a first connecting portion 15*a* and a second connecting portion 15*b* that are connected to the conductor (the second conductor pattern 15) are provided. A connection direction L, in which the first connecting portion 15*a* and the second connecting portion 15*b* are arranged, on the other surface 11*b* of the substrate 11, is different from a lateral direction of the substrate 11.

Further, in the heater 1 according to the embodiment to be described below, the connection direction L extends along the longitudinal direction of the substrate 11.

In addition, the conductor (the second conductor pattern 15) in the heater 1 according to the embodiment to be described below only includes portions (a first portion 15*c*-1 and a third portion 15*c*-3) that are extended along the longitudinal direction of the substrate 11, and a portion (a second portion 15*c*-2) that is extended in a direction inclined with respect to the longitudinal direction and the lateral direction of the substrate 11.

Further, the resistance heat-generating element 12 in the heater 1 according to the embodiment to be described below includes a plurality of heat-generating portions 12*a*. The plurality of heat-generating portions 12*a* are disposed along the longitudinal direction of the substrate 11 on one surface 11*a* of the substrate 11. The thermistor 14 is provided at a plurality of positions in the longitudinal direction of the substrate 11.

Furthermore, an image forming apparatus according to an embodiment to be described below includes a heater and a pressure roller. The heater heats a medium. The pressure roller applies pressure to the medium heated by the heater. The image forming apparatus fixes toner attached to the medium using the heater and the pressure roller.

Embodiment

Figure 2:
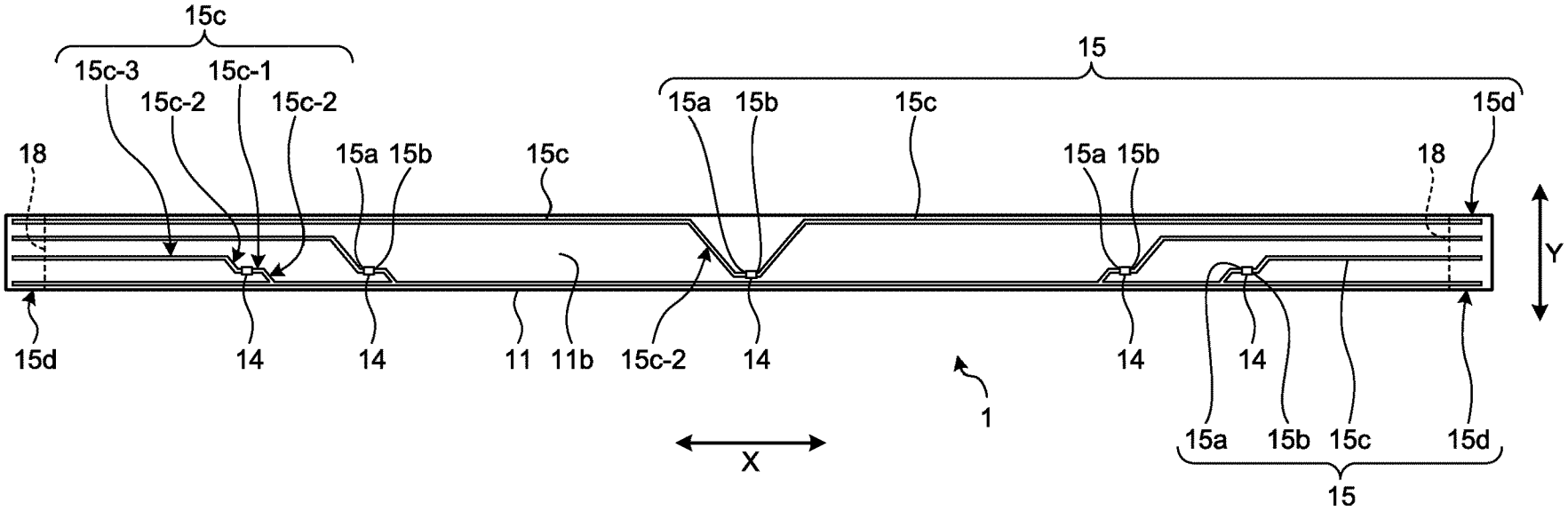
FIG. 2 is a plan view illustrating the heater according to the embodiment, seen from the other surface side of the substrate.

Hereinafter, a heater according to an embodiment will be described with reference to the accompanying drawings. FIG. 1 is a plan view illustrating a heater according to an embodiment, seen from one surface side of a substrate. FIG. 2 is a plan view illustrating the heater according to the embodiment, seen from the other surface side of the substrate. The heater according to this embodiment is mounted in an electronic device such as an image forming apparatus, and for example, is used for heating sheets that pass through the heater.

Configuration of Heater

As illustrated in FIG. 1, a heater 1 according to this embodiment includes a rectangular substrate 11, a plurality of resistance heat-generating elements 12, and a plurality of first conductor patterns (heat-generating element conductor patterns) 13 for supplying power to the plurality of resistance heat-generating elements 12. Further, as illustrated in FIG. 2, the heater 1 includes a plurality of thermistors (temperature measuring elements) 14 for measuring temperature of the substrate 11, and a plurality of belt-shaped second conductor patterns (thermistor conductor patterns) 15 that are conductors for respectively supplying power to the plurality of thermistors 14. In FIG. 1 and subsequent figures, the longitudinal direction of the substrate 11 is represented as an X-direction, and the lateral direction of the substrate 11 is represented as a Y-direction.

The substrate 11 is formed of, for example, ceramic such as alumina, glass ceramic, a heat resistant composite material, or the like, in an elongated shape, and has heat resistance and insulation. The thickness of the substrate 11 is formed to have a thickness of about 0.5 mm to about 1.0 mm, for example.

As illustrated in FIG. 1, on one surface (front surface) 11*a* of the substrate 11 in a thickness direction, the plurality of resistance heat-generating elements 12 and the plurality of first conductor patterns 13 are formed. The resistance heat-generating elements 12 and the first conductor patterns 13 are coated with a protective layer (overcoat layer) 18. Further, as illustrated in FIG. 2, on the other surface (rear surface) 11*b* that is a rear side of one surface 11*a* of the substrate 11, the plurality of thermistors 14 and the plurality of second conductor patterns 15 are formed. The thermistors 14 and the second conductor patterns 15 are coated with the protective layer 18. The protective layer 18 is formed to have a thickness of about 10 μm to about 60 μm, for example, so that the resistance heat-generating elements 12, the first conductor patterns 13, the thermistors 14, and the second conductor patterns 15 are mechanically, chemically, and electrically protected.

As illustrated in FIG. 1, the resistance heat-generating elements 12 include belt-shaped resistance heat-generating elements 12 that extend along the longitudinal direction (X-direction) of the substrate 11. On one surface 11*a* of the substrate 11, two resistance heat-generating elements 12 are disposed along both sides of the substrate 11 in the lateral direction (Y-direction). Further, on one surface 11*a* of the substrate 11, three first conductor patterns 13, which extend along the longitudinal direction of the substrate 11 and which are spaced from each other in the lateral direction of the substrate 11, are formed. Two resistance heat-generating elements 12 are formed between the first conductor patterns 13 that are adjacent to each other in the lateral direction of the substrate 11. In the plurality of first conductor patterns 13, a first electrode portion 13*b* is formed in both end portions of the substrate 11 in the longitudinal direction of the substrate 11. Further, a conducting portion 13*a* of the first conductor patterns 13, which is disposed at the center of the substrate 11 in the lateral direction, includes a plurality of second electrode portions 13*c* that are spaced from each other in the longitudinal direction of the substrate 11. The number of the first conductor patterns 13 is not limited to three. The number of the first conductor patterns 13 may be five or seven in accordance with the sizes of recording sheets.

The resistance heat-generating elements 12 generate heat as electric current flows therein, and for example, are formed of a material including ruthenium oxide ($RuO_2$), silver-palladium (Ag—Pd) alloy, or the like. The resistance heat-generating elements 12 are formed, by coating resistance heat-generating element paste on the substrate 11 and curing the resistance heat-generating element paste.

The first conductor patterns 13 include the linear conducting portion 13*a* that extends along the longitudinal direction of the substrate 11, the first electrode portions 13*b* and the second electrode portions 13*c* which are respectively connected to terminal members that supply power.

The conducting portions 13*a* are arranged in two rows along the longitudinal direction (X-direction) of the substrate 11, and are respectively disposed on both sides of the substrate 11 in the lateral direction (Y-direction) of the substrate 11. Respective heat-generating portions 12*a* of the resistance heat-generating elements 12 are disposed on and along the two-row conducting portions 13*a*. The first electrode portions 13*b* are respectively disposed in both end portions of the substrate 11 in the longitudinal direction of the substrate 11, and are formed over both end portions of the two-row conducting portions 13*a*. Three second electrode portions 13*c* are disposed to be spaced from each other in the longitudinal direction in intermediate portions of the substrate 11 in the longitudinal direction, and are provided between the heat-generating portions 12*a* that are arranged in two rows. The first conducting patterns 13 are formed of a silver-based material such as silver (Ag), silver-palladium (Ag—Pd), or silver-platinum (Ag—Pt), for example, and are formed, by coating low resistance conductor paste on one surface 11*a* of the substrate 11 and curing the low resistance conductor paste.

As illustrated in FIG. 2, the plurality of thermistors 14 are provided at a plurality of positions of the substrate 11 in the longitudinal direction, on the other surface 11*b* of the substrate 11. That is, the plurality of thermistors 14 are respectively disposed to be spaced from each other between the center of the substrate 11 in the longitudinal direction (X-direction) of the substrate 11 and both end sides of the substrate 11 in the longitudinal direction of the substrate 11. Further, the plurality of thermistors 14 are arranged in one row to be positioned on one straight line along the longitudinal direction of the substrate 11. The thermistors 14 are formed using a printing pattern, and have a characteristic of a temperature coefficient of resistance (TCR) that is equal to or smaller than −1000 ppm/° C.

Accordingly, in the heater 1, with respect to the rear surface 11*b* of the substrate 11 with which a recording sheet M (which will be described later) is in slidable contact, temperatures of a plurality of positions of the substrate 11 in the longitudinal direction are respectively detected by the plurality of thermistors 14. In the heater 1, a controller (not illustrated) controls a voltage supplied to the resistance heat-generating elements 12 on the basis of the detection results of the plurality of thermistors 14. Specifically, by controlling a voltage supplied between the first electrode portions 13*b* and the second electrode portions 13*c*, the amount of heat generated by the resistance heat-generating element 12 is controlled. Further, the plurality of thermistors 14 are disposed so that intervals between the thermistors 14 are gradually decreased from the center of the substrate 11 in the longitudinal direction of the substrate 11 toward both end sides thereof. Thus, on the both end sides of the substrate 11 in the longitudinal direction of the substrate 11, the thermistors 14 are disposed at a relatively narrow interval. The disposition of the plurality of thermistors 14 is not limited to the configuration illustrated in FIG. 2. The respective thermistors 14 may be disposed on both end sides in the longitudinal direction of the substrate 11, for example, at a relatively wide interval with respect to the longitudinal direction. Further, the respective thermistors 14 may be disposed at approximately equal intervals in the longitudinal direction of the substrate 11.

Connection Structure Between Thermistors and Second Conductor Patterns

Figure 3:
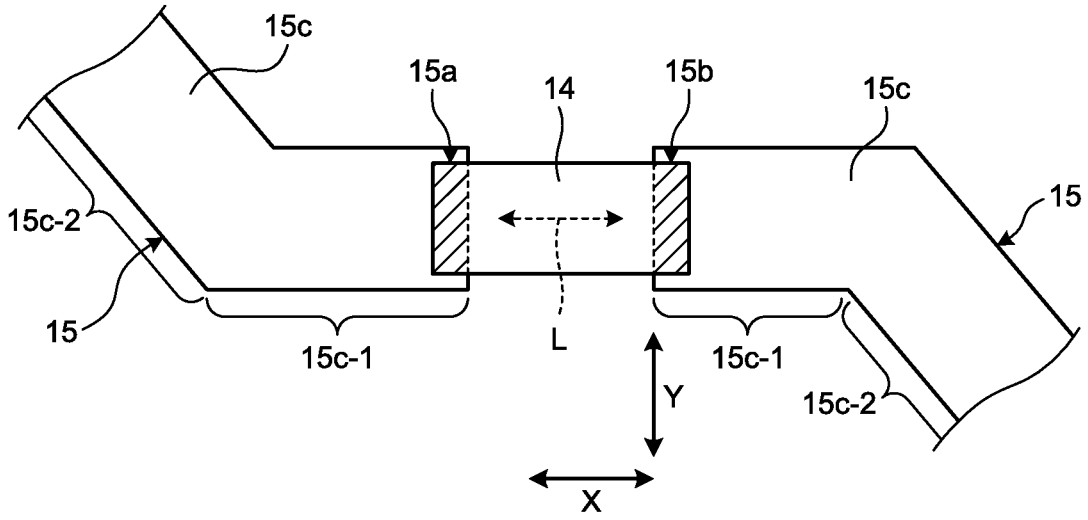
FIG. 3 is an enlarged view illustrating a connection state between a thermistor and a second conductor pattern included in the heater according to the embodiment.

FIG. 3 is an enlarged view illustrating a connection state between the thermistors 14 and the second conductor patterns 15, included in the heater according to this embodiment. As illustrated in FIG. 3, each thermistor 14 is formed by a rectangular printing pattern, and is formed so that the longitudinal direction of the thermistor 14 extends along the longitudinal direction (X-direction) of the substrate 11. Both ends in the longitudinal direction of the thermistor 14 are connected to the second conductor patterns 15.

As illustrated in FIGS. 2 and 3, each second conductor pattern 15 includes a first connecting portion 15*a* and a second connecting portion 15*b* that are connected to both ends of the thermistors 14 in the longitudinal direction, a linear conducting portion 15*c* that extends up to end portions in the longitudinal direction (X-direction) of the substrate 11, and an electrode portion 15*d* which is connected to each terminal member (not illustrated) that supplies power. Further, the second conductor patterns 15 electrically connect the respective thermistors 14 to each other. In this embodiment, the first connecting portion 15*a* and the second connecting portion 15*b* are represented as shaded regions in FIG. 3. The first connecting portion 15*a* and the second connecting portion 15*b* are formed by overlapping both ends of the thermistor 14 on the conducting portion 15*c* of the second conductor pattern 15 that is formed on the other surface 11*b* of the substrate 11.

As illustrated in FIG. 3, the connection direction L, in which the first connecting portion 15*a* and the second connecting portion 15*b* are arranged on the other surface 11*b* of the substrate 11, is different from the lateral direction (Y-direction) of the substrate 11. In this embodiment, as an example, the connection direction L extends along the longitudinal direction (X-direction) of the substrate 11, and the first connecting portion 15*a* and the second connecting portion 15*b* are disposed to be arranged in the longitudinal direction of the substrate 1. Accordingly, electric current flows in the thermistor 14 along the longitudinal direction of the substrate 11.

As the first connecting portion 15*a* and the second connecting portion 15*b* are disposed to be arranged in the longitudinal direction (X-direction) of the substrate 11, a configuration, in which the first connecting portion 15*a* and the second connecting portion 15*b* are continuously disposed along the lateral direction (Y-direction) of the substrate 11, is prevented. In other words, only one connecting portion is disposed on one straight line that extends along the lateral direction of the substrate 11, and thus, a configuration, in which a plurality of connecting portions are disposed on one straight line, is prevented. As the thermistor 14 and the conducting portion 15*c* are connected to each other so that the first connecting portion 15*a* and the second connecting portion 15*b* are disposed in this way, an unevenness difference (step size), which is generated between a projection portion generated in a thickness direction of the substrate 11 by the first connecting portion 15*a* and the second connecting portion 15*b*, and a recording sheet M (see FIG. 6) sent along the lateral direction of the substrate 11 while being in indirectly slidable contact with the other surface 11*b* of the substrate 11 through a fixing film (not illustrated), is reduced.

Further, the conducting portion 15*c* includes, a first portion 15*c*-1 that extends in the longitudinal direction (X-direction) of the substrate 11 from the first connecting portion 15*a* and the second connecting portion 15*b*, a second portion 15*c*-2 that extends in a direction inclined with respect to both of the longitudinal direction and the lateral direction (Y-direction) of the substrate 11, and a third portion 15*c*-3 that extends up to the electrode portion 15*d* along the longitudinal direction of the substrate 11. As the conducting portion 15*c* is routed in this way, the conducting portion 15*c* includes only the first portion 15*c*-1 and the third portion 15*c*-3 that extend along the longitudinal direction of the substrate 11, and the second portion 15*c*-2 that extends in a direction inclined with respect to the longitudinal direction and the lateral direction of the substrate 11, and does not include a portion that extends along the lateral direction of the substrate 11. The second portion 15*c*-2 of the conducting portion 15*c* extends in a direction inclined by about 45°, for example, with respect to the lateral direction (Y-direction) of the substrate 11. Further, the plurality of conducting portions 15*c* is disposed to be spaced from each other in the lateral direction of the substrate 11.

Since the conducting portion 15*c* does not include a portion that extends along the lateral direction (Y-direction) of the substrate 11, a configuration, in which the conducting portion 15*c* is continuously formed along the lateral direction of the substrate 11, is prevented. Thus, an unevenness difference, which is generated between a projection portion generated in the thickness direction of the substrate 11 by the conducting portion 15*c* and a recording sheet M sent along the lateral direction of the substrate 11 while being in indirectly slidable contact with the other surface 11*b* of the substrate 11 through a fixing film, is reduced. The conducting portion 15*c* in this embodiment includes the first portion 15*c*-1, but a configuration, in which the second portion 15*c*-2 is directly extended from the first connecting portion 15*a* and the second connecting portion 15*b* without through the first portion 15*c*-1, may be used.

The electrode portions 15*d*, which is included in the second conductor patterns 15, are formed in end portions of the third portions 15*c*-3 of the conducting portions 15*c* that are extended up to the end portions of the substrate 11 in the longitudinal direction (X-direction). In the end portions in the longitudinal direction of the substrate 11, the electrode portions 15*d* are disposed to be spaced from each other in the lateral direction (Y-direction) of the substrate 11. The electrode portions 15*d* are connected to terminal members connected to a power source (not illustrated) of an electronic apparatus such as an image forming apparatus, so that power is supplied to the thermistors 14 through the terminal members.

Figure 4:
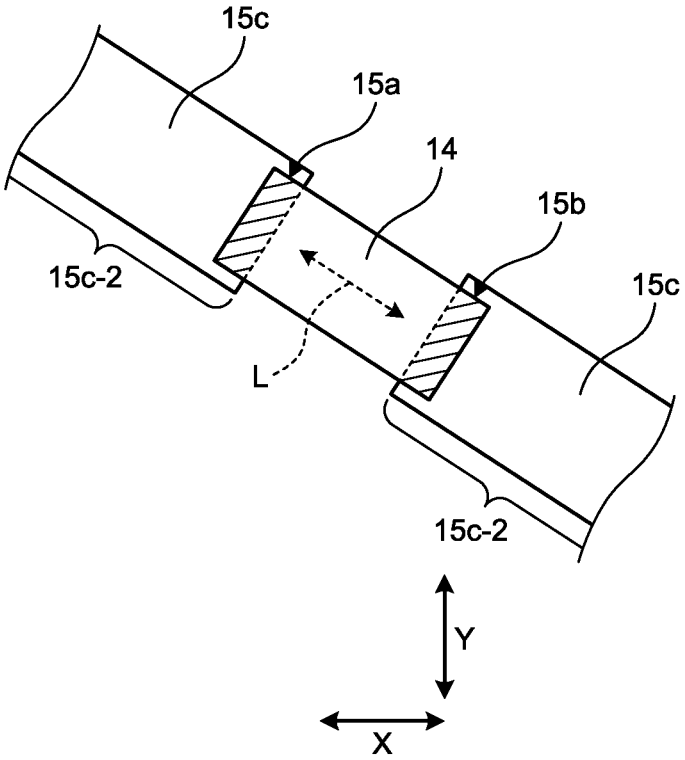
FIG. 4 is an enlarged view illustrating a modification example of the connection state between the thermistor and the second conductor pattern included in the heater according to the embodiment.

Modification Example of Connection Structure Between Thermistors and Conductors FIG. 4 is an enlarged view illustrating a modification example of the connection state between the thermistor 14 and the second conductor pattern 15 included in the heater 1 according to the embodiment. As illustrated in FIG. 4, a longitudinal direction of the rectangular thermistor 14 may be inclined with respect to the longitudinal direction and the lateral direction of the substrate 11. At both ends of the thermistor 14, a second portion 15*c*-2, which extends in the direction that is inclined with respect to the longitudinal direction and the lateral direction of the substrate 11, is formed. The second portion 15*c*-2 may be directly extended from the first connecting portion 15*a* and the second connecting portion 15*b* along the longitudinal direction of the substrate 11.

Thus, in the modification example, similarly, since the connection direction L, in which the first connecting portion 15*a* and the second connecting portion 15*b* are arranged, is inclined with respect to the longitudinal direction and the lateral direction of the substrate 11, a configuration, in which the first connecting portion 15*a* and the second connecting portion 15*b* are continuously disposed along the lateral direction of the substrate 11, is prevented. Thus, friction between a projection portion, which is generated in the thickness direction of the substrate 11 by the first connecting portion 15*a* and the second connecting portion 15*b*, and a recording sheet M sent along the lateral direction of the substrate 11 while being in slidable contact with the other surface 11*b* of the substrate 11, is reduced.

Modification Examples 1 and 2 of Resistance Heat-Generating Element

Figure 5:
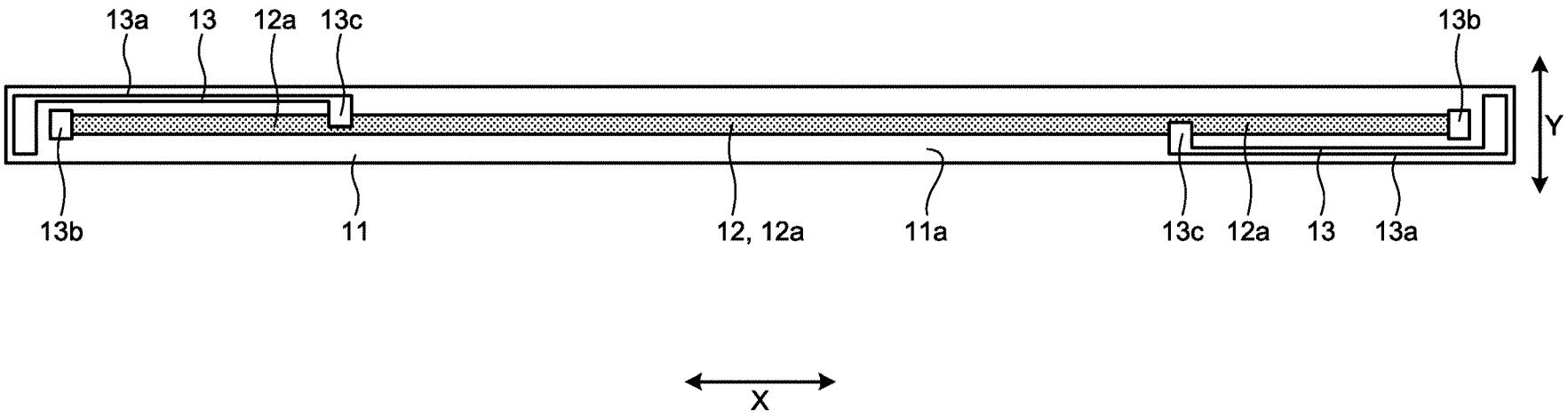
FIG. 5 is a plan view illustrating Modification Example 1 of a resistance heat-generating element included in the heater according to the embodiment, seen from one surface side of the substrate.
Figure 6:
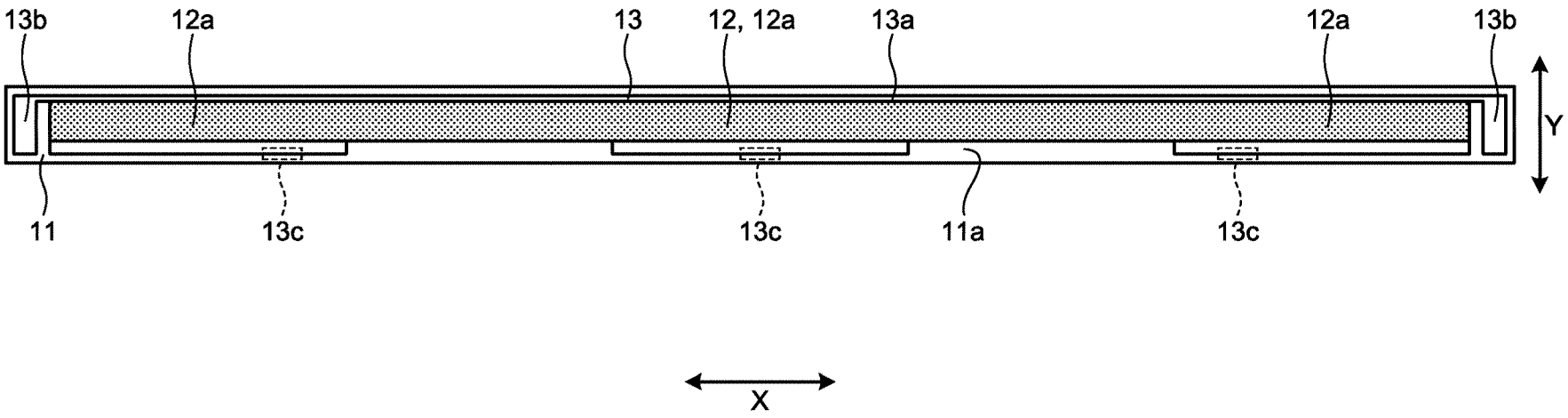
FIG. 6 is a plan view illustrating Modification Example 2 of the resistance heat-generating element included in the heater according to the embodiment, seen from one surface side of the substrate.

FIG. 5 is a plan view illustrating Modification Example 1 of the resistance heat-generating element 12 included in the heater 1 according to the embodiment, seen from one surface side of the substrate 11. FIG. 6 is a plan view illustrating Modification Example 2 of the resistance heat-generating element included in the heater according to the embodiment, seen from one surface side of the substrate 11. Modification Examples 1 and 2 are different from the embodiment in that a single resistance heat-generating element 12 is disposed along the longitudinal direction (X-direction) of the substrate 11. In Modification Examples 1 and 2, similarly, the same reference numerals as in the embodiment are given to the same components, and description thereof will not be repeated.

As illustrated in FIG. 5, on one surface 11*a* of the substrate 11 in Modification Example 1, one resistance heat-generating element 12 is disposed at the center in the lateral direction (Y-direction) of the substrate 11 along the longitudinal direction (X-direction) of the substrate 11. Further, on one surface 11*a* of the substrate 11, two first conductor patterns 13, which extend from both end sides in the longitudinal direction of the substrate 11 toward a central side thereof, are formed along the longitudinal direction of the substrate 11. The two first conductor patterns 13 include first electrode portions 13*b* that are formed in both end portions in the longitudinal direction of the resistance heat-generating element 12. A conducting portion 13*a* of each first conductor pattern 13 is extended along the longitudinal direction of the substrate 11, and includes a second electrode portion 13*c* that is connected to a central portion in the longitudinal direction of the resistance heat-generating element 12.

As illustrated in FIG. 6, on one surface 11*a* of the substrate 11 in Modification Example 2, similar to Modification Example 1, one resistance heat-generating element 12 is disposed at an approximately center in the lateral direction (Y-direction) of the substrate 11 along the longitudinal direction (X-direction) of the substrate 11. Further, on one surface 11*a* of the substrate 11, one first conductor pattern 13, which has a conducting portion 13*a* that extends along the longitudinal direction of the substrate 11, is formed. In the first conductor pattern 13, first electrode portions 13*b* are formed in both end portions in the longitudinal direction of the substrate 11. In addition, the first conductor pattern 13 includes a plurality of second electrode portions 13*c* which is disposed to be spaced from each other in the longitudinal direction of the resistance heat-generating element 12 on one side that runs along the longitudinal direction of the resistance heat-generating element 12.

Sending Direction of Recording Sheet with Respect to Heater

Figure 7:
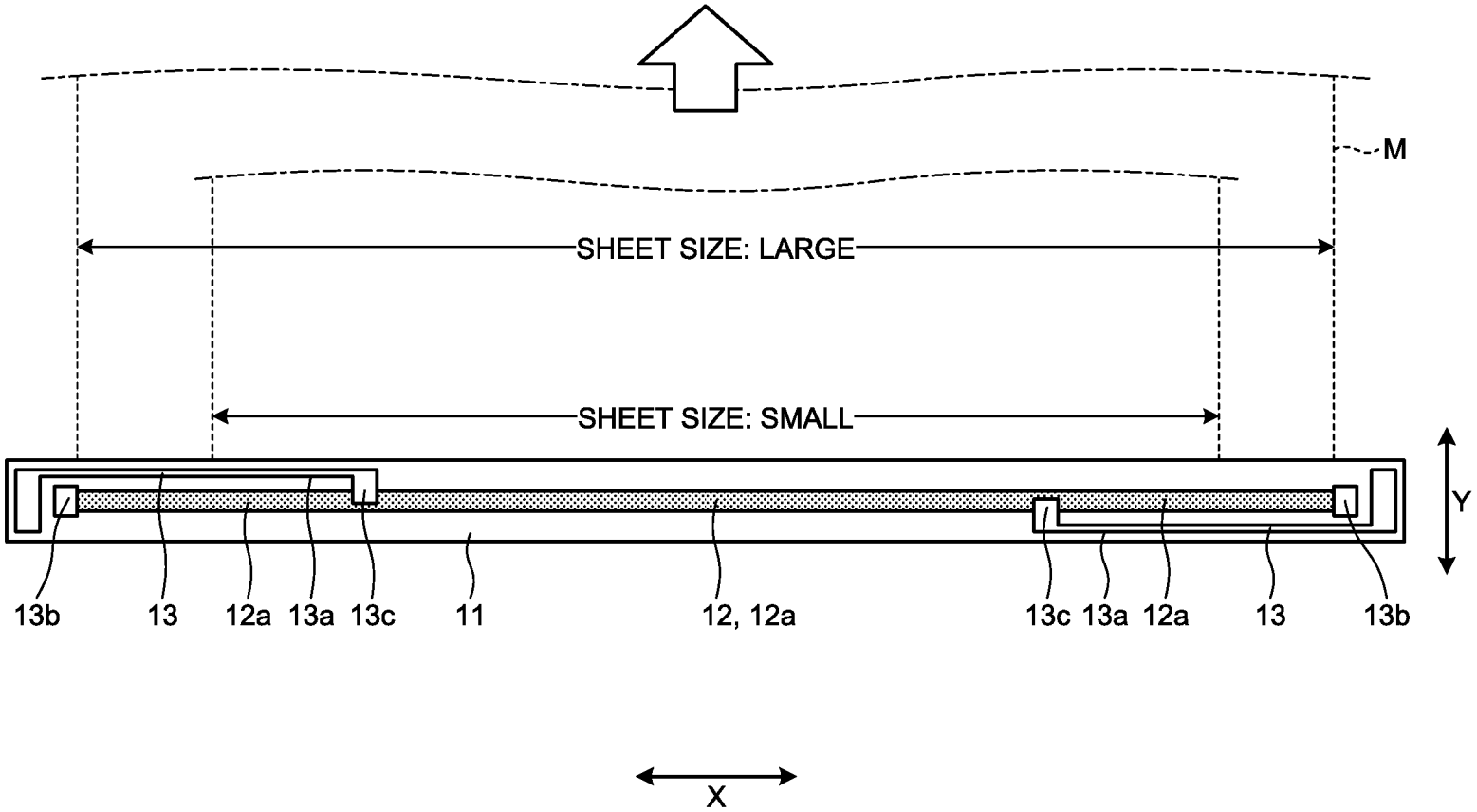
FIG. 7 is a schematic view illustrating positions of various recording sheets heated by the heater according to the embodiment.

FIG. 7 is a schematic view illustrating positions of various recording sheets heated by the heater 1 according to the embodiment. In FIG. 7, as an example, the heater 1 that includes the resistance heat-generating element 12 in Modification Example 1 illustrated in FIG. 5 is illustrated. As illustrated in FIG. 7, in the heater 1 of the embodiment, when various recording sheets M are heated by the heater 1, the recording sheets M are sent along the lateral direction (Y-direction) of the substrate 11 while being in indirectly slidable contact with the other surface 11*b* of the substrate 11 through a fixing film. As the various recording sheets M of which recording widths (lengths with respect to the longitudinal direction of the substrate 11) are different from each other, for example, a recording sheet of a letter (LTR) size (recording width: 215.9 mm) that is a large sheet size, a recording sheet of a B5 size (recording width: 182.0 mm) that is a small sheet size, and the like, may be used. The resistance heat-generating element 12 of the heater 1 is formed to have, for example, a length of 222.0 mm in the longitudinal direction of the substrate 11. The various recording sheets M are sent with respect to the heater 1 with the center of the recording width being aligned with the center in the longitudinal direction of the substrate 11. The sizes of the recording sheets M are not limited to the above description, and for example, the large sheet size may be an A4 size (recording width: 210.0 mm), or the small sheet size may be a postcard size (recording width: 100 mm).

A heating target body heated by the heater 1 is not limited to the recording sheets M, and may be a different type of heating target body such as a film. Further, the exemplary embodiment is not limited to the configuration in which a heating target body moves with respect to the heater 1, and may be applied to a configuration in which the heater 1 relatively moves with respect to a heating target body.

The heater 1 of the above-described embodiment includes, the first connecting portion 15*a* and the second connecting portion 15*b* in which both ends of the thermistor 14 and the second conductor pattern 15 are connected to each other, and the connection direction L, in which the first connecting portion 15*a* and the second connecting portion 15*b* are arranged on the other surface 11*b* of the substrate 11, is different from the lateral direction (Y-direction) of the substrate 11. Thus, a configuration, in which the first connecting portion 15*a* and the second connecting portion 15*b* are continuously disposed along the lateral direction of the substrate 11, is prevented, and thus, it is possible to reduce an unevenness difference, which is generated between a projection portion that is generated in the thickness direction of the substrate 11 by the first connecting portion 15*a* and the second connecting portion 15*b*, and the recording sheet M sent along the lateral direction of the substrate 11 while being in indirectly slidable contact with the other surface 11*b* of the substrate 11. As a result, with respect to the recording sheet M that is indirectly in slidable contact with the first connecting portion 15*a* and the second connecting portion 15*b*, it is possible to reduce printing unevenness (stripes in printing) due to the influence of continuous slidable contact. Thus, it is possible to improve recording quality. In addition, it is also possible to enhance durability of the heater 1.

Particularly, in order to improve detection accuracy in the thermistor 14 to efficiently perform detection, there is a case where the thermistor 14 is disposed immediately under the protective layer 18, and the thickness of the protective layer 18 is formed to be thin to increase heat conductivity. In this case, on the other surface 11*b* of the substrate 11 with which the recording sheet M is in slidable contact, unevenness due to the second conductor pattern 15 or the thermistor 14 easily occurs. In such a case, by applying the heater 1 of this embodiment, it is possible to further prevent printing unevenness from occurring in the recording sheet M, and to improve recording quality and durability of the heater 1.

Further, the second conductor pattern 15 in the heater 1 of the embodiment includes only the first portion 15*c*-1 and the third portion 15*c*-3 that extend along the longitudinal direction of the substrate 11, and the second portion 15*c*-2 that extends in a direction inclined with respect to the longitudinal direction and the lateral direction of the substrate 11. Thus, in the conducting portion 15*c* of the second conductor pattern 15, a portion, which extends in the lateral direction of the substrate 11, is eliminated, and thus, a configuration, in which the conducting portion 15*c* is continuously disposed along the lateral direction of the substrate 11, is prevented. Thus, it is possible to reduce an unevenness difference, which is generated between a projection portion generated in the thickness direction of the substrate 11 by the conducting portion 15*c* and the recording sheet M sent along the lateral direction of the substrate 11 while being in indirectly slidable contact with the other surface 11*b* of the substrate 11. Accordingly, according to the heater 1, it is possible to further reduce printing unevenness in the recording sheet M, and to improve recording quality and durability of the heater 1.

Further, the resistance heat-generating element 12 in the heater 1 of the embodiment includes the heat-generating portion 12*a* that is disposed along the longitudinal direction of the substrate 11 on one surface 11*a* of the substrate 11, in which the thermistors 14 are provided at a plurality of positions in the longitudinal direction of the substrate 11. Thus, it is possible to detect a temperature distribution in the longitudinal direction of the substrate 11 using the plurality of thermistors 14 with high accuracy, and to effectively control the resistance heat-generating element 12 so that the temperature distribution is made uniform.

Configuration of Fixing Device

Figure 8:
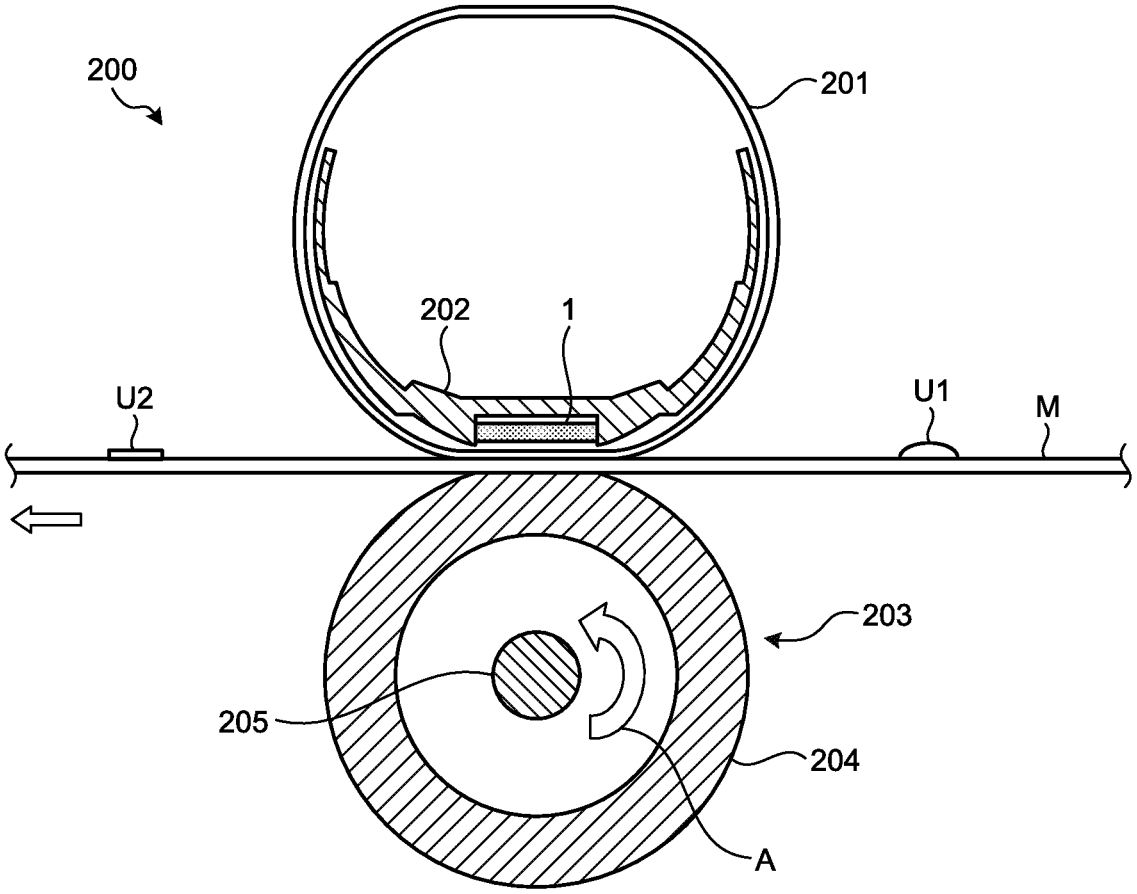
FIG. 8 is a cross-sectional view illustrating a fixing device according to an embodiment in which the heater according to the embodiment is used.

Next, a fixing device of the embodiment using the heater 1 of the embodiment will be described with reference to the accompanying drawings. FIG. 8 is a cross-sectional view illustrating a fixing device according to an embodiment in which the heater 1 according to the embodiment is used. As illustrated in FIG. 8, a fixing device 200 has a configuration in which the heater 1 is provided in a lower part of a fixing film belt 201 wound around a support 202 in a cylindrical shape. The fixing film belt 201 is formed of a heat-resistant resin material such as polyimide. At a position that faces the heater 1 and the fixing film belt 201, a pressure roller 203 is disposed. The pressure roller 203 includes a heat-resistant elastic material, for example, a silicone resin layer 204 on its surface, and may rotate around a rotary axis 205 (in an A direction in FIG. 8) in a state of being in a pressure contact with the fixing film belt 201.

In a toner fixing process, on a contact plane between the fixing film belt 201 and the silicone resin layer 204, a toner image U1, which is attached to a recording sheet (copy sheet) M that is a medium, is heated and melted by the heater 1 through the fixing film belt 201. As a result, at least a surface portion of the toner image U1 exceeds a melting point, and is thus softened and melted. Then, on a sheet discharge side of the pressure roller 203, the recording sheet M is spaced from the heater 1 and is simultaneously spaced from the fixing film belt 201, so that a toner image U2 naturally radiates heat to be further cured, and thus, the toner image U2 is fixed to the recording sheet M.

Configuration of Image Forming Apparatus

Figure 9:
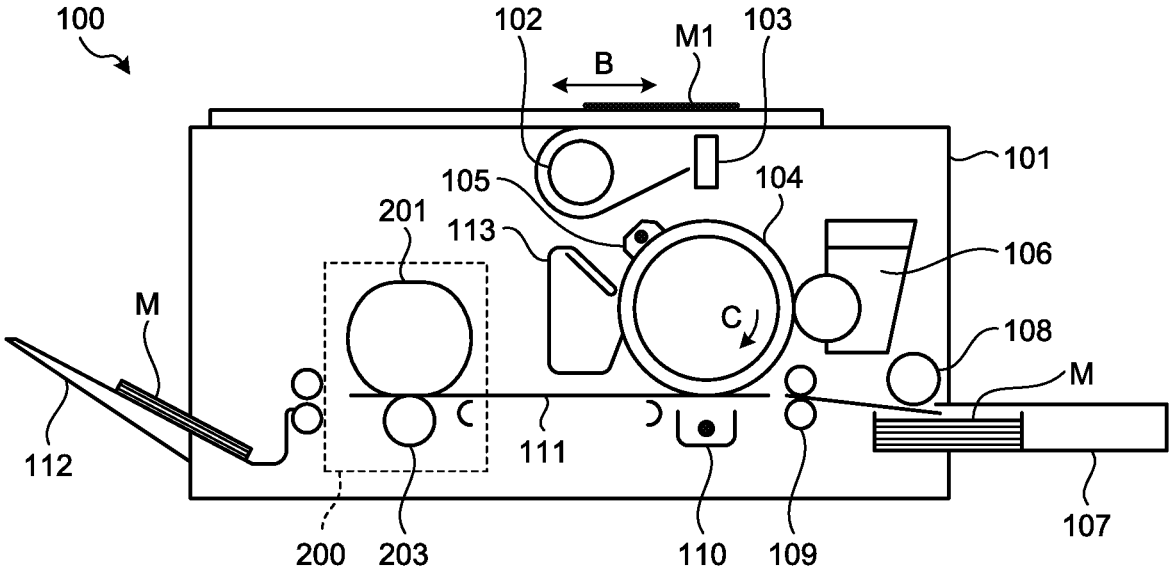
FIG. 9 is a cross-sectional view illustrating an image forming apparatus according to an embodiment in which the heater according to the embodiment is used.

Finally, an image forming apparatus according to an embodiment including the heater 1 of the embodiment will be described with reference to the accompanying drawings. FIG. 9 is a cross-sectional view illustrating an image forming apparatus according to an embodiment in which the heater 1 according to the embodiment is used. The image forming apparatus of this embodiment is configured as a copier 100. As illustrated in FIG. 9, in the copier 100, respective components, which include the above-described fixing device 200, are provided in a housing 101. In an upper part of the housing 101, a document loading stand made of a transparent material such as glass is provided, and a document M1, which is a reading target of image information, is reciprocated on the document loading stand (in a B direction in FIG. 9) for scanning.

In an upper part in the housing 101, a lighting device 102, which includes a light emitting lamp and a reflecting mirror, is provided. Light emitted from the lighting device 102 is reflected on a surface of the document M1 on the document loading stand, and is slit-exposed onto a photosensitive drum 104 by a short focus small diameter image forming element array 103. The photosensitive drum 104 is provided to be rotatable (in a C direction in FIG. 9). Further, in the vicinity of the photosensitive drum 104 disposed in the housing 101, a charging unit 105 is provided. The photosensitive drum 104 is uniformly charged by the charging unit 105. The photosensitive drum 104 is coated with a zinc oxide photosensitive layer or an organic semiconductor photosensitive layer, for example. On the charged photosensitive drum 104, an electrostatic image, for which image exposure is performed by the short focus small diameter image forming element array 103, is formed. The electrostatic image is developed using toner made of resin or the like that is softened and melted by heating of a developer 106 to form a toner image.

The recording sheet M accommodated in a cassette 107 is sent onto the photosensitive drum 104 by a pair of transport rollers 109 rotated while being in a pressure contact with each other in a vertical direction in synchronization with a feed roller 108 and the toner image on the photosensitive drum 104. Further, the toner image on the photosensitive drum 104 is transferred onto the recording sheet M using a transfer discharger 110. Then, the recording sheet M, which is sent from the photosensitive drum 104 to a downstream side, is guided to the fixing device 200 using a transport guide 111, and is heated and fixed (the above-described toner fixing process), and then, is discharged to a tray 112. After the toner image is transferred, the remaining toner on the photosensitive drum 104 is removed by a cleaner 113.

In the fixing device 200, the heater 1 is provided in a state of being pressed against the silicone resin layer 204 that is provided at an outer peripheral part of the pressure roller 203. The heater 1 includes the resistance heat-generating element 12 having a width larger than an effective length fitted to a maximum size sheet width (length) that may be copied by the copier 100, that is, a maximum size sheet width (length) in a width direction of the recording sheet M orthogonal to a transport direction of the recording sheet M. Further, an unfixed toner image on the recording sheets M that are sent between the heater 1 and the pressure roller 203, is melt using heat generated by the resistance heat-generating element 12, so that a copy image made of letters, signs, images or the like is displayed on the recording sheet M.

An example, in which the heater 1 of the embodiment is applied as a fixing heater of an image forming apparatus such as the copier 100, has been described, but the use of the heater 1 is not limited thereto. The heater 1 of the embodiment may be mounted in a household appliance, a business-use precision machine, an experimental precision machine, a chemical reaction device, or the like, and may be used as a heat source for heating or heating warm.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A heater comprising:

a rectangular substrate;

a resistance heat-generating element that is provided on one surface of the substrate, which is orthogonal to a thickness direction of the substrate, along a longitudinal direction of the substrate;

a thermistor that is provided on another surface, which is a rear side of the one surface of the substrate, and measures temperature of the substrate; and a conductor that is provided on the other surface of the substrate, is extended up to an end portion of the substrate from the thermistor along the longitudinal direction of the substrate, and supplies power to the thermistor, wherein the conductor includes a first connecting portion connected to one end of the thermistor and a second connecting portion connected to an opposite end of the thermistor, and a connection direction, in which the first connecting portion positioned at the one end of the thermistor and the second connecting portion positioned at the opposite end of the thermistor are arranged on the other surface of the substrate, is different from a lateral direction of the substrate.

2. The heater according to claim 1, wherein the connection direction extends along the longitudinal direction of the substrate.

3. The heater according to claim 1, wherein the conductor includes only a portion that extends along the longitudinal direction of the substrate and a portion that extends in a direction inclined with respect to the longitudinal direction and the lateral direction of the substrate.

4. The heater according to claim 1, wherein the resistance heat-generating element includes a heat generating portion that is disposed on the one surface of the substrate along the longitudinal direction of the substrate, and the thermistor is provided at a plurality of positions in the longitudinal direction of the substrate.

5. An image forming apparatus comprising:

the heater according to claim 1 that heats a medium; and a pressure roller that applies pressure to the medium heated by the heater, wherein toner, which is attached to the medium, is fixed by the heater and the pressure roller.

* * * * *